US011335470B1

(12) United States Patent
Oka et al.

(10) Patent No.: US 11,335,470 B1
(45) Date of Patent: May 17, 2022

(54) IN-GLOVEBOX CONTAINER

(71) Applicant: Triad National Security, LLC, Los Alamos, NM (US)

(72) Inventors: Jude M. Oka, Espanola, NM (US); Timothy A. Stone, White Rock, NM (US)

(73) Assignee: Triad National Security, LLC, Los Alamos, NM (US)

( * ) Notice: Subject to any disclaimer, the term of this patent is extended or adjusted under 35 U.S.C. 154(b) by 0 days.

(21) Appl. No.: 17/145,127

(22) Filed: Jan. 8, 2021

Related U.S. Application Data

(60) Provisional application No. 62/961,964, filed on Jan. 16, 2020.

(51) Int. Cl.
*G21F 5/12* (2006.01)
*G21F 5/14* (2006.01)

(52) U.S. Cl.
CPC . *G21F 5/12* (2013.01); *G21F 5/14* (2013.01)

(58) Field of Classification Search
CPC ..... G21F 5/12; G21F 5/14
USPC ..... 250/505.1, 506.1, 507.1, 515.1, 516.1, 250/517.1, 518.1, 519.1
See application file for complete search history.

(56) References Cited

U.S. PATENT DOCUMENTS

2012/0325821 A1* 12/2012 Mookerjee ..... F17C 3/02 220/560.1

OTHER PUBLICATIONS

Kams, Tristan, et al., "Hydrophobic Filter Material for Nuclear Material Transportation and Storage Containers", LA-UR-16-28605. 2016 LANL Report.

Oka, Jude M., et al., "Initial Engineering Evaluations of the New In-Glovebox Container Designs", Proceedings of the 19th International Symposium on the Packaging and Transportation of Radioactive Materials, PATRAM 2019, Aug. 4-9, 2019, New Orleans, LA, USA.

* cited by examiner

*Primary Examiner* — Nicole M Ippolito
(74) *Attorney, Agent, or Firm* — Alston & Bird LLP

(57) ABSTRACT

A container having two different closing mechanism designs including an upright strike-less latch design and a Buttress thread design.

20 Claims, 8 Drawing Sheets

IN-GLOVEBOX CONTAINER

CROSS-REFERENCE TO RELATED APPLICATION

This application claims the benefit of U.S. Provisional Application No. 62/961,964, filed on Jan. 16, 2020. The subject matter thereof is hereby incorporated herein by reference in its entirety.

STATEMENT OF FEDERAL RIGHTS

The United States government has rights in this invention pursuant to Contract No. 89233218CNA000001 between the United States Department of Energy and Triad National Security, LLC for the operation of Los Alamos National Laboratory.

FIELD

The present invention generally relates to containment for nuclear materials management.

BACKGROUND

Containers play a pivotal role in nuclear materials management. The complicated nature of constantly crediting containers due to continuously changing requirements, have increased the challenges on defining the containers performance objectives. Issues have emerged that allude to the need for changes in the way containers are managed in specific environments. Factors, such as Material-At-Risk (MAR) and Damage Ratio (DR), are well known and documented for containers used outside the glovebox; however, designing containers for in glove-box applications is more complicated with new requirements. For example, a new requirements documentation (RD) has outlined the primary performance objectives for in-glovebox use including being able to withstand a glovebox fire, a drop or fall from a minimum height of 12 feet and a leak test that is completed by immersing the container in water to a depth of up to 6 inches above the top of the container for a duration of two hours.

Accordingly, an improved container for nuclear material management may be beneficial.

SUMMARY

Certain embodiments of the present invention may provide solutions to the problems and needs in the art that have not yet been fully identified, appreciated, or solved by conventional nuclear material management. For example, some embodiments pertain a container having two different closing mechanism designs including an upright strike-less latch design and a Buttress thread design.

In an embodiment, an apparatus for nuclear materials management includes a base container, a container lid, and a rubber-like seal. The apparatus also includes a pair of latches holding the container lid. The pair of latches are tack welded on the container base at or about 120 degrees apart from each other, and a distance between the final placement of the pair of latches and the container lid is dependent on a gasket compression, which is ~20 percent.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Some embodiments pertain a container having two different closing mechanism designs including an upright strike-less latch design and a Buttress thread design. Initial engineering evaluations show both the latch container and threaded design can achieve a DR value of 0.01 after a drop. The threaded design, however, is the solely watertight container after the drop. The container may also be incorporated into other existing container systems, such as the SAVY-4000.

Performance Requirement Identification

The new RD defines the design requirements for the new general use container designs for glovebox work. The intent behind this document is to capture key aspects of container function and performance considerations across a variety of programmatic process needs for both filtered/vented and hermetic seal containment options. The main drivers for this new container involve criticality requirements for the container to remain watertight under accident scenarios and Material-At-Risk (MAR) credibility for the container to be able to prevent the release of material under accident scenarios.

Design Selection

The filter utilized in both container types will utilize the new filter that consists of the current ceramic fiber base with the addition of a new perfluorooctyl-trichlorosilane (PFOTS) treatment. The new PFOTS will be hydrophobic at high temperatures will maintaining material integrity under high gamma does rates.

Figure 1:
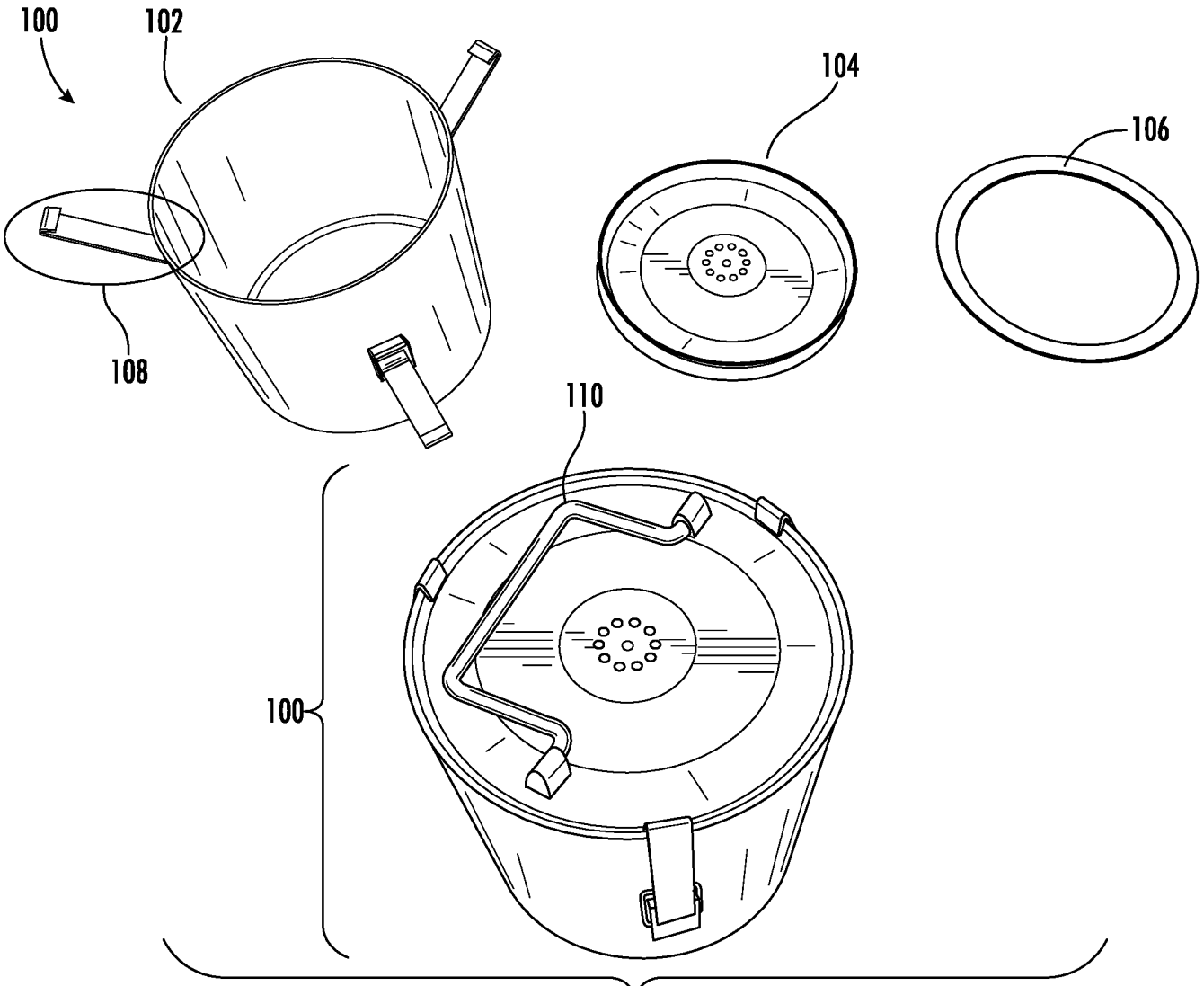
FIG. 1 is an image of a strike-less design of a container, according to an embodiment of the present invention.

FIG. 1 is an image of a strike-less design of a container 100, which includes a base container 102, a container lid 104, and a rubber-like seal 106. Latches 108 to hold container lid 104 are also shown in FIG. 1.

Latches in some embodiments are tack welded on container base 102 at or about 120 degrees apart from each other. The distance between the final placement of each latch 108 and lid 104 is dependent on the gasket compression. The desired compression on the gasket is approximately 20%. This is accomplished by estimating the squeeze at 20% compression through the model.

Handle 110 on lid 104 is composed of a ⅛" diameter 316L stainless steel bar, bent in 4 places at 90°. Handle 110 is assembled onto lid 104 by fitting the ends into small stainless steel housings that are tacked welded onto lid 104. The housing for handle 110 is hollow which allows handle 110 to rotate freely along its axis.

Figure 2:
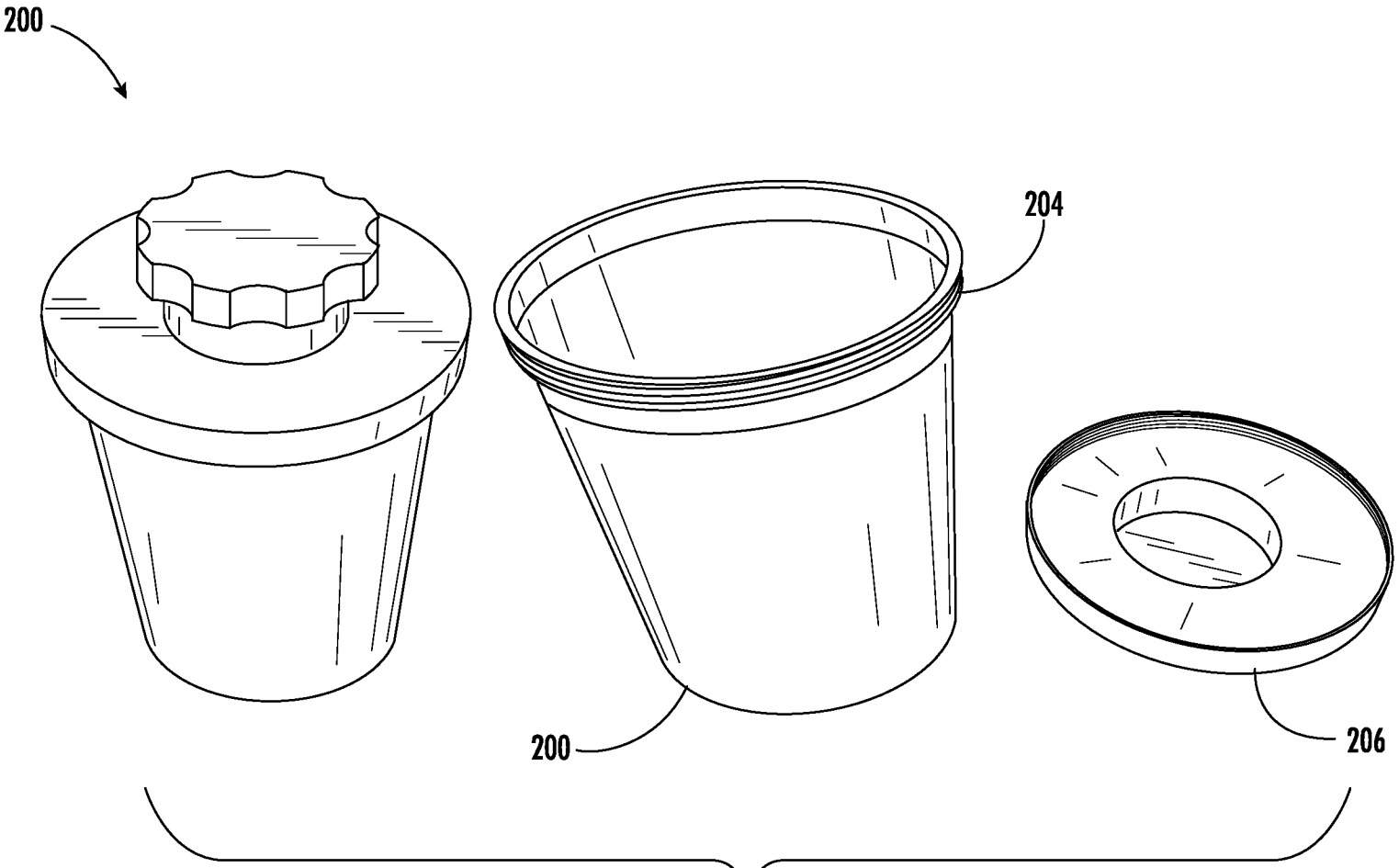
FIG. 2 is an image of a buttress threaded design of a container, according to an embodiment of the present invention.

In some embodiments, such as that shown in FIG. 2, container 200 utilizes a unique buttress threaded design. This unique thread 204 is used to handle extreme axial pulse loading or burst in the axial direction. One side of the thread is perpendicular to the axis while the flank angle is slanted at 45°. The combination equates to a longer thread base for increased shear strength on the threads. In addition, in this embodiment, the features from this thread are relied on for the relief of pressurization. The threads act as a tortuous path for gas when significant pressure builds within the container, resulting in the removal of a filter. The sealing will be compensated by creating a knife edge seal at the contact surface between the lid and the body. This feature assists with keeping the container watertight.

In some embodiments, lid 206 is fully machined from an aluminum bronze material. This distinct material was selected so galling between the threads can be mitigated. A new knob was also machined to assist with closing the threaded lid onto the body.

Preliminary Results

Initial engineering evaluation was conducted on both the threaded and latch designs, testing included water ingress testing and drop testing with a cerium oxide (CeO2) simulant. The initial engineering evaluation provides a basis for design performance where the water ingress was measured before and after drop testing while also measuring the mass loss to estimate the airborne mass loss (g) and respirable mass loss (g). Measuring the mass loss is key to determining the damage ratio (DR value) for each design.

Figure 3:
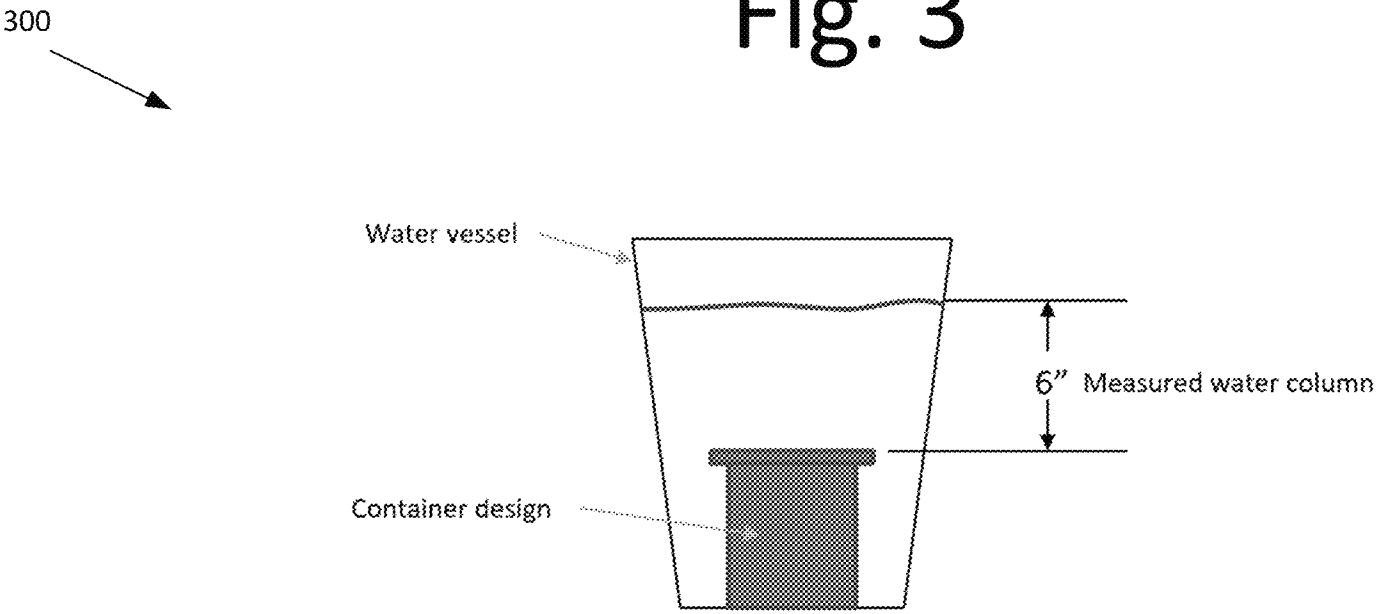
FIG. 3 is a diagram illustrating a water ingress testing schematic, according to an embodiment of the present invention.

Water ingress testing required the use of a test vessel that held the 6" of water column, timer and a mass balance. See, for example, FIG. 3, which is a diagram illustrating a water ingress testing schematic 300, according to an embodiment of the present invention. Each container was weighed before and after being submersed to determine mass difference. This was done on a Monobloc sr64001 balance with an accuracy of 0.1 grams and a maximum measurement of 64100 grams. The containers were weighted down to eliminate the buoyancy effect that causes the containers. Both containers remained submerged for 2 hours then pulled and effort was made to dry the outer surfaces before post weight measurement were recorded. Table 1 below, shows the pre drop water ingress results assuming a density of water to be 1 g/ml.

TABLE 1

Pre Drop Water Ingress
Pre-Drop Water Ingress Results

| | |
|---|---|
| Latch Design | 0.9 g |
| Threaded Design | 18.4 g |

The container was dropped using a drop tower and the mass release fraction was measured using a particle counter and a calibrated balance.

For actual drop tests, three replicate tests of controlled drops (with the same potential energy of the tested container) were performed to measure the background resuspension aerosol. The background values for the respirable and airborne mass are determined at different potential energy values. These values are variable from drop to drop; and therefore, the background is determined for each drop, especially in the cases of significant powder release from previous experiments. The container potential energy in Joules can be determined from equation (1).

$$PE=m*g*h \qquad \text{Equation (1)}$$

where m=container mass, g is the gravitational acceleration, and h is the drop height.

In each drop, the angle was noted both before the drop and at the time of impact. The angle at impact is determined based on the high speed video footage, using the edge of the impact plate as the zero datum and determining the angle of the container based on that datum using a digital angle finder held against the computer screen. The drop angle chosen was the orientation of center of gravity over top corner of the container (CG over top corner), this orientation is considered to be worst case and will impose the most damage onto the container.

Figure 4:
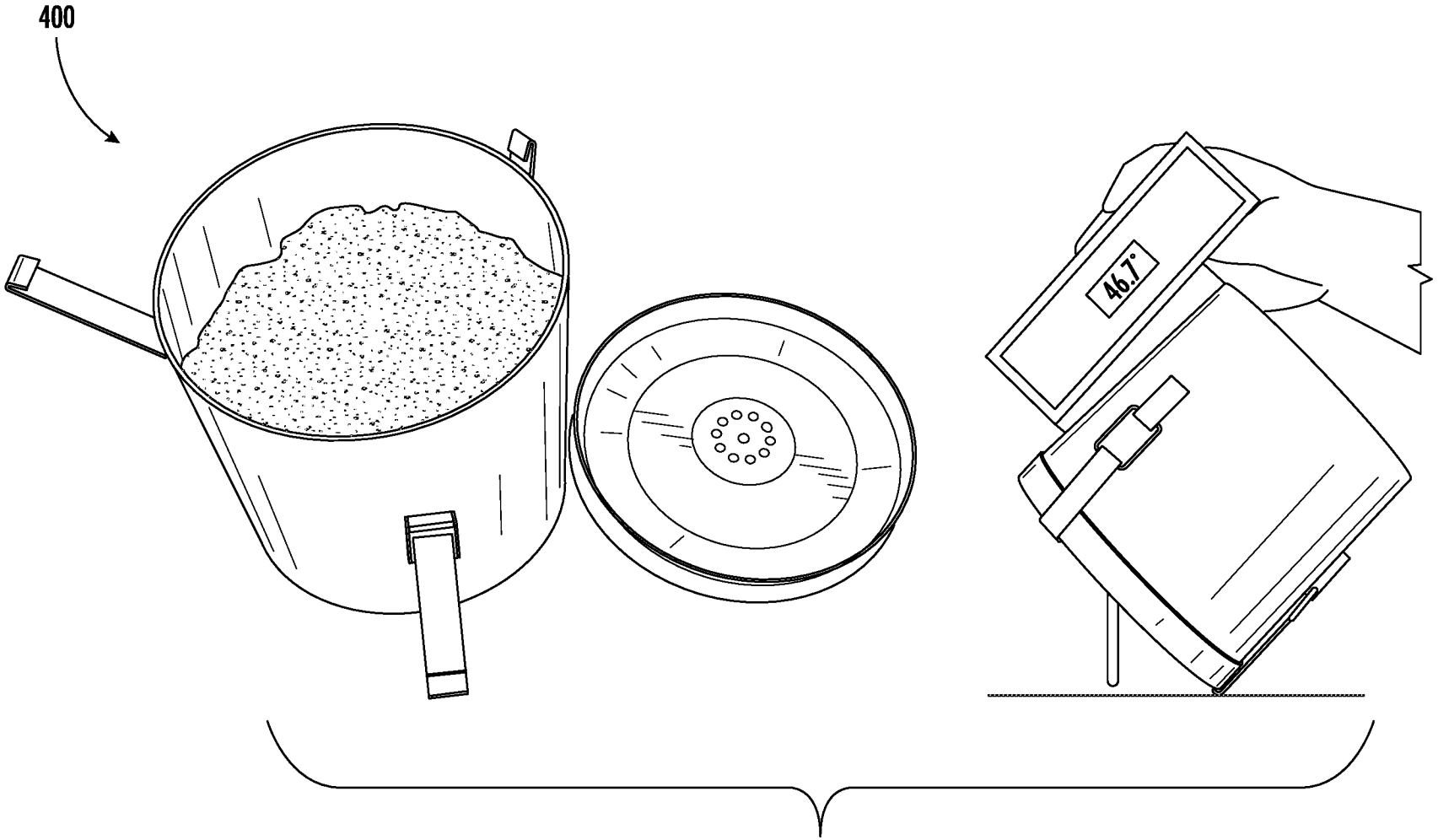
FIG. 4 is an image illustrating (a) latch container payload and (b) drop angle determination, according to an embodiment of the present invention.

The latched design was dropped with a payload weight that is considered to be the maximum for the 3 qt size, the simulant was inclusive with the payload. The container payload was comprised of metal shot to achieve the desired test mass with loose CeO2 powder directly on top of the shot. See, for example, FIG. 4, which is an image 500 illustrating a latch container payload and drop angle determination, according to an embodiment of the present invention. The details of the drop are included in Table 2.

TABLE 2

Latch Container Drop Testing Results

| | |
|---|---|
| CeO2 MAR (g) | 401.1 |
| Gross Weight Pre-Drop (g) | 9001.5 |
| Gross Weight Post-Drop (g) | 9001.6 |
| Released Mass, dm (g) | 1.8 |
| Drop Orientation | CG over top corner |
| Pre-Drop Angle | 46.7° |
| Drop Height (ft) | 12 |
| Drop Energy (joules) | 324 |
| DR Value | 4.5E−03 |

Figure 5:
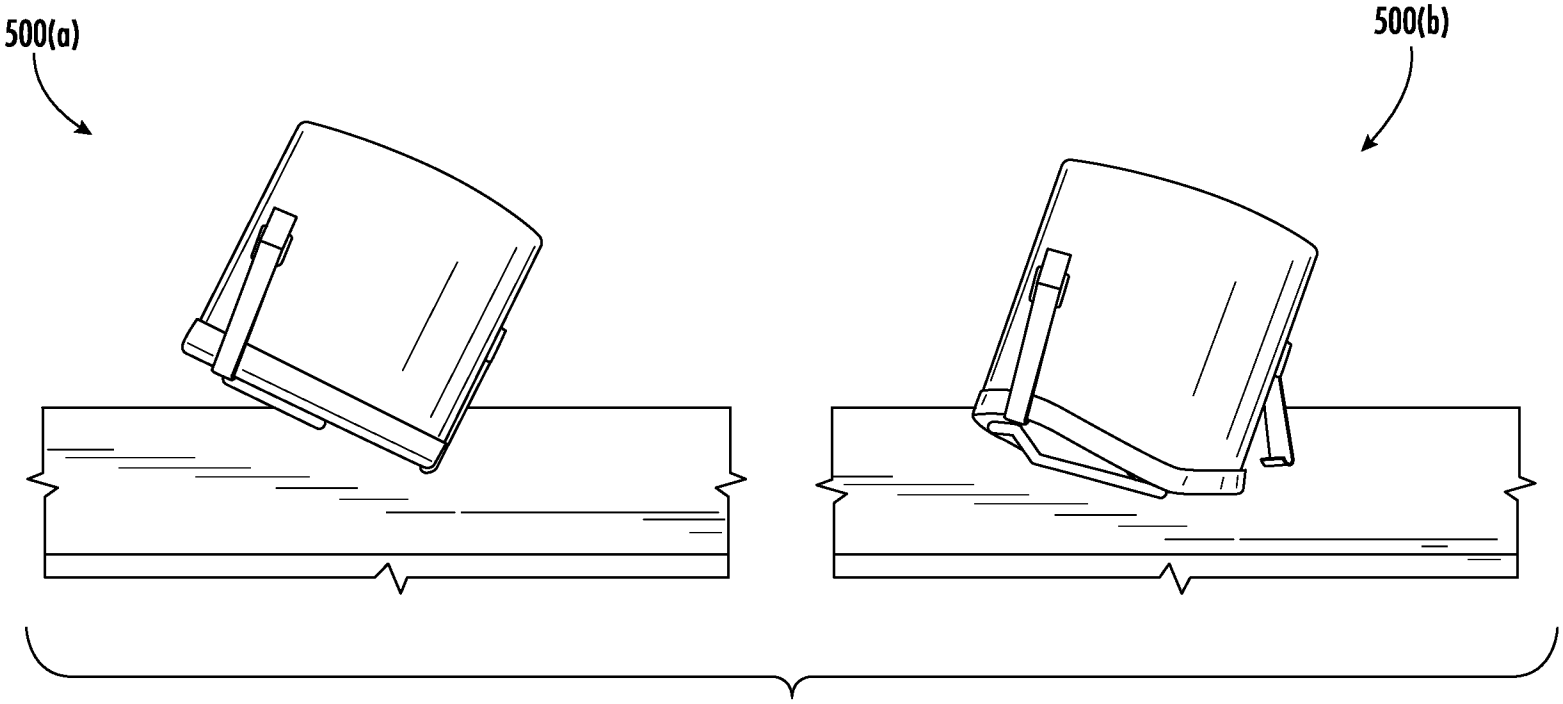
FIG. 5 is an image illustrating a latch container impact, according to an embodiment of the present invention.

FIG. 5 are images 500(*a*) and 500(*b*) illustrating latch container impact, according to an embodiment of the present invention. In images 500(*a*) and 500(*b*), when the container hit the impact plate, the container deformed and released test powder into the air. Two of the three latches popped open during the impaction, but the lid stayed on. White test powder was spilled on the impact plate, after testing the spilled test powder was swept up and collected, and the remainder was vacuumed up into an analytical open face filter holder. The total collected test powder weight was approximately 1.8037 g.

Figure 6:
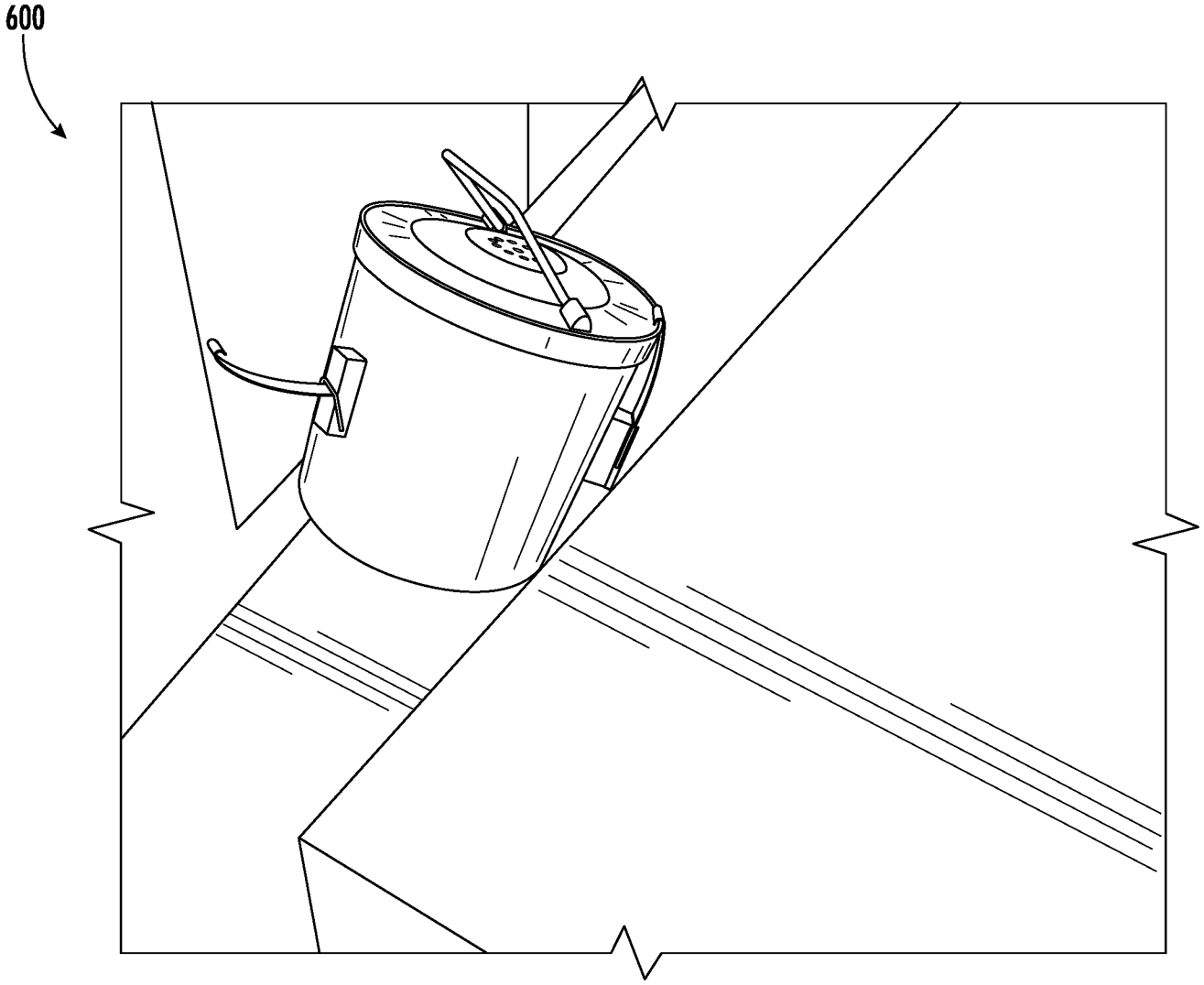
FIG. 6 is an image illustrating a latch container post drop impact, according to an embodiment of the present invention.
Figure 7:
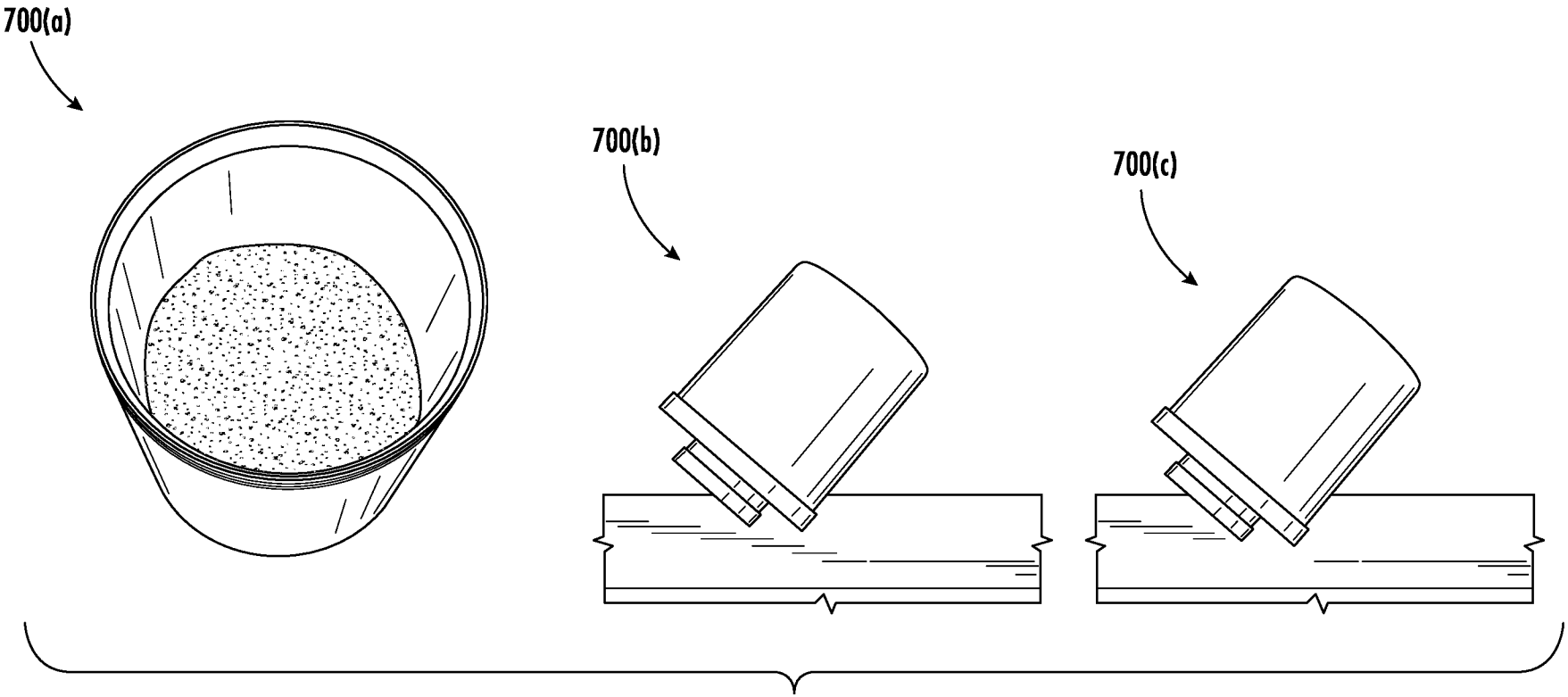
FIG. 7 is an image illustrating (a) a threaded container payload and (b) impact thereof, according to an embodiment of the present invention.

The gross weight of tested container before drop was 9001.5 g, the gross weight after drop was measured as 9001.6 g. FIG. 6 is an image 600 illustrating a latch container post drop impact, according to an embodiment of the present invention. In FIG. 7, CeO2 powder is shown on the impact plate. There is a measurement discrepancy between the initial and final gross weight of the container and the measured released mass. There was a two day time interval between the initial weighing and the drop test. Cerium oxide is hygroscopic, and it is possible the CeO2 powder absorbed water vapor and increased the overall mass of the container.

After subtracting the 324 J facility background from the measured respirable mass and airborne mass, the net respirable mass and net airborne release can be found in Table 3.

TABLE 3

Spilled (or Released) Mass Results of the Latch Container

| | Respirable Mass, g | Airborne Mass, g |
|---|---|---|
| Background at 324 J | 6.02E−05 +− 5.41E−05 | 9.11E−05 +− 8.39E−05 |
| Net Latched Design | 1.94E−02 +− 1.31E−03 | 3.22E−02 +− 2.12E−03 |

The threaded design was dropped with a payload weight that is considered to be the maximum for the 3 qt size, the simulant was inclusive with the payload. FIG. 7 are images 700(*a*)-(*c*) illustrating threaded container payload and impact, according to an embodiment of the present invention. In FIG. 7, the container payload was comprised of metal shot to achieve the desired test mass with loose CeO2 powder directly on top of the shot along with the container impact. The details of the drop are included in Table 4.

TABLE 4

Threaded Container Drop Testing Results

| | |
|---|---|
| CeO2 MAR(g) | 402.5 |
| Gross Weight Pre-Drop (g) | 9003.7 |
| Gross Weigh Post-Drop (g) | 9003.7 |
| Released Mass, dm (g) | 0.0872 |
| Drop Orientation | CG over top corner |
| Pre-Drop Angle | 41.5° |
| Drop Height (ft) | 12 |
| Drop Energy (joules) | 324 |
| DR Value | 2.17E−04 |

When the container hit the impact plate (see FIG. 7), the container deformed and the lid jumped a thread but stayed on. No visible powder puff was observed in the hi-speed video. However, test powder was observed on the impact plate after the drop.

After subtracting the 324 J background from the measured respirable mass and airborne mass, the net respirable mass and the net airborne mass released can be found in Table 5.

TABLE 5

Spilled (or Released) Mass Results of the Threaded Container

| | Respirable Mass, g | Airborne Mass, g |
|---|---|---|
| Background at 324 J | 6.02E−05 +− 5.41E−05 | 9.11E−05 +− 8.39E−05 |
| Net Threaded Design | 5.59E−04 +− 6.81E−05 | 8.90E−04 +− 1.10E−04 |

Figure 8:
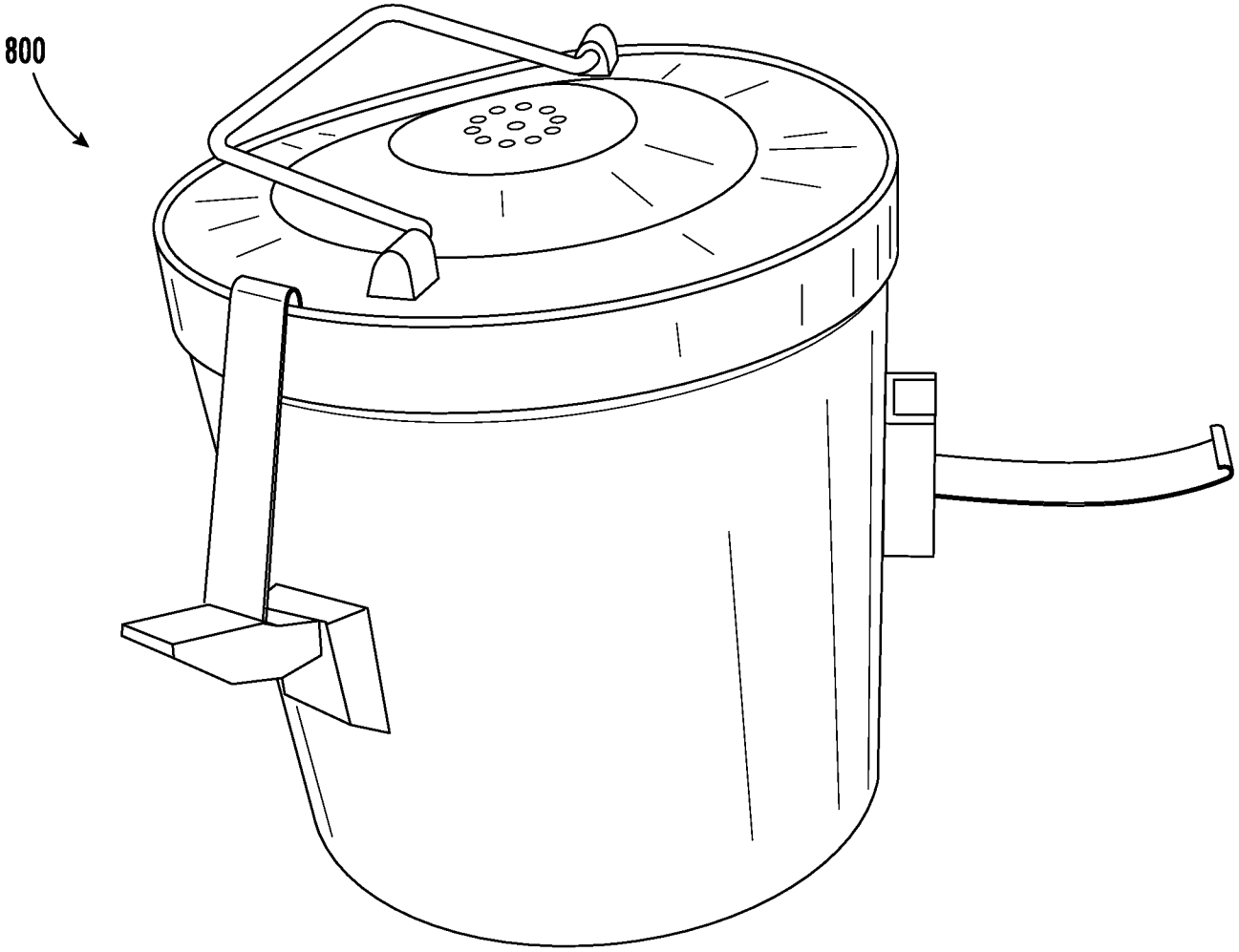
FIG. 8 is an image illustrating a latch container post drop deformation, according to an embodiment of the present invention.

The latched design container test revealed a vulnerability in a CG over top corner drop. Two latches opened in the latched design drop test, with one of those latches coming completely unlatched. FIG. 8 is an image 800 illustrating latch container post drop deformation, according to an embodiment of the present invention. As shown in image 800, examination of the container after the drop revealed a visible gap between the lid and the container body. The Damage Ratio values for both design types are well below 1% material loss providing a positive closure mechanism with minimum release after an accident scenario and a DR value of at least 0.01.

Due to the latch design experiencing enough deformation to create a gap between the lid and body, the container was not tested for water ingress, under the current test requirements the container would have filled entirely with water. In contrast, the threaded design was water resistant after the drop results can be seen in Table 6.

TABLE 6

Post Water Ingress Results
Pre-Drop Water Ingress Results

| | |
|---|---|
| Latch Design | N/A |
| Threaded Design | 41.1 g |

The new prototypes show promise for performance testing based on functionality checks and initial engineering evaluations. Functionality checks included opening/closing of each design and the overall engineering judgment on sealing with emphasis on performance while initial engineering evaluations composed of water ingress testing and drop testing with a plutonium simulant for DR, airborne mass and respirable mass values estimations. Water ingress testing was completed under 6" water column (W.C) for 2 hours while trying to prevent the entry of no more than 50 mil. of water followed by dropping testing at the RRFMC. Glovebox fire testing was not conducted on these containers due to not having access to a convection oven that meets the glovebox fire requirements, this testing is will be completed in the near future. Results show the latched design is watertight at a pristine state while drop testing reveals a 1.8037 g powder loss resulting in DR value of at least 0.01 with minimum airborne mass and respirable mass values, due to the deformation caused at impact the container was not tested and cannot be considered watertight post drop. The threaded design also showed to be water tight at a pristine state while drop testing reveals a 0.00872 g powder loss resulting in a DR value of at least 0.01 with minimum airborne mass and respirable mass values, the threaded design also passed post drop water ingress testing and therefore can be considered water tight after a drop scenario. The threaded design container had about two orders of magnitude less mass loss than the attached design container. Currently, the threaded design container shows more promise than the latched design but, design consideration are being made for better latches.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus for nuclear materials management, comprising:

a container base, a container lid, and a rubber-like seal; and a pair of latches holding the container lid, wherein the pair of latches are tack welded on the container base at or about 120 degrees apart from each other, and a distance between each of the latches and the container lid is dependent on a gasket compression, the gasket compression being is ~20 percent.

2. The apparatus of claim 1, further comprising:

a handle on the container lid being composed of a ⅛" diameter 316L stainless steel bar, bent in four places at 90°.

3. The apparatus of claim 2, wherein the handle is assembled onto the container lid by fitting ends of the handle into stainless steel housings, the stainless steel housings are tacked welded onto the container lid.

4. The apparatus of claim 3, further comprising:

a housing for the handle is hollow, allowing the handle to rotate freely along an axis of the handle.

5. The apparatus of claim 1, further comprising:

buttress threads configured to handle extreme axial pulse loading or burst in the axial direction, wherein a first side of the buttress threads is perpendicular to an axis while a flank angle is slanted at 45°, equating to a longer thread base for increased shear strength on the buttress threads.

6. The apparatus of claim 5, wherein the buttress thread is further configured to provide relief of pressurization, and act as a tortuous path for gas when significant pressure builds within the apparatus, resulting in removal of a filter.

7. The apparatus of claim 1, wherein the rubber-like seal provides a seal compensated by creating a knife edge seal at a contact surface between the container lid and a body of the container base, keeping the apparatus watertight.

8. The apparatus of claim 1, wherein the container lid is fully machined from an aluminum bronze material, mitigating galling between buttress threads.

9. The apparatus of claim 8, further comprising:

a knob machined in assisting with closing the container lid onto a body of the container base.

10. An apparatus for nuclear materials management, comprising:

a container base, a container lid, and a rubber-like seal; and a pair of latches holding the container lid, wherein the pair of latches are tack welded on the container base at or about 120 degrees apart from each other, and a distance between each of the latches and the container lid is dependent on a gasket compression, the gasket compression being ~20 percent; and buttress threads configured to handle extreme axial pulse loading or burst in the axial direction, wherein a first side of the buttress threads is perpendicular to an axis while a flank angle is slanted at 45°, equating to a longer thread base for increased shear strength on the buttress threads.

11. The apparatus of claim 10, further comprising:

a handle on the container lid being composed of a ⅛" diameter 316L stainless steel bar, bent in four places at 90°.

12. The apparatus of claim 11, wherein the handle is assembled onto the container lid by fitting ends of the handle into stainless steel housings, the stainless steel housings are tacked welded onto the container lid.

13. The apparatus of claim 12, further comprising:

a housing for the handle is hollow, allowing the handle 110 to rotate freely along an axis of the handle.

14. The apparatus of claim 13, wherein the buttress thread is configured to provide relief or pressurization, and act as a tortuous path for gas when significant pressure builds within the apparatus, resulting in removal of a filter.

15. The apparatus of claim 10, wherein the rubber-like seal provide a seal compensated by a creation of a knife edge seal at a contact surface between the container lid and a body of the container base, keepings the apparatus watertight.

16. The apparatus of claim 10, wherein the container lid is fully machined from an aluminum bronze material, mitigating galling between buttress threads.

17. The apparatus of claim 16, further comprising:

a knob machined in assisting with closing the lid onto a body of the container base.

18. An apparatus for nuclear materials management, comprising:

a container base, a container lid, and a rubber-like seal; and a pair of latches holding the container lid, wherein the pair of latches are tack welded on the container base at or about 120 degrees apart from each other, and a distance between each of the latches and the container lid is dependent on a gasket compression, the gasket compression being ~20 percent; and a handle on the container lid being composed of about ⅛" diameter 316L stainless steel bar, bent in four places at 90°.

19. The apparatus of claim 18, wherein the handle is assembled onto the container lid by fitting ends of the handle into stainless steel housings, the stainless steel housings are tacked welded onto the container lid.

20. The apparatus of claim 19, further comprising:

a housing for the handle is hollow, allowing the handle to rotate freely along an axis of the handle.

* * * * *